US007270581B2

(12) United States Patent
Tiberio

(10) Patent No.: US 7,270,581 B2
(45) Date of Patent: Sep. 18, 2007

(54) CONTACT TERMINATION MEMBER FOR AN ELECTRICAL RECEPTACLE

(75) Inventor: Patrick J. Tiberio, Bridgeport, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 11/313,730

(22) Filed: Dec. 22, 2005

(65) Prior Publication Data

US 2007/0149069 A1 Jun. 28, 2007

(51) Int. Cl.
*H01R 11/22* (2006.01)

(52) U.S. Cl. ..... 439/856; 439/857

(58) Field of Classification Search ..... 439/856, 439/857, 654, 439, 440, 441
See application file for complete search history.

(56) References Cited

U.S. PATENT DOCUMENTS

| | | | | |
|---|---|---|---|---|
| 2,291,434 | A | 7/1942 | Hollopeter | |
| 2,705,785 | A | 4/1955 | Benander | |
| 3,255,428 | A | 6/1966 | Robbins | |
| 3,325,768 | A | 6/1967 | Munroe | |
| 3,489,985 | A | 1/1970 | Martin | |
| RE26,994 | E | 12/1970 | Fuller | |
| 3,609,642 | A | 9/1971 | Norden | |
| 3,967,873 | A | 7/1976 | Schumacher | |
| 4,342,496 | A * | 8/1982 | Hutter et al. | 439/578 |
| 4,342,498 | A | 8/1982 | Patton | |
| 4,673,232 | A | 6/1987 | Kubota | |
| 4,687,278 | A | 8/1987 | Grabbe | |
| 4,722,579 | A | 2/1988 | Cummings | |
| 4,892,488 | A | 1/1990 | Nestor | |
| 5,147,230 | A | 9/1992 | Plyler | |
| 5,149,279 | A | 9/1992 | Kruse | |
| 5,427,553 | A | 6/1995 | Tsuji | |
| 5,637,000 | A * | 6/1997 | Osterbrock et al. | 439/107 |
| 6,128,181 | A * | 10/2000 | Higami et al. | 361/600 |
| 6,881,091 | B2 | 4/2005 | Brandl | |

* cited by examiner

*Primary Examiner*—Tho D. Ta
*Assistant Examiner*—Vanessa Girardi
(74) *Attorney, Agent, or Firm*—Alfred N. Goodman; Mark S. Bicks

(57) ABSTRACT

A contact termination member for an electrical receptacle is provided that has a base. A first spring arm is connected to the base and has a first free end. A second spring arm is connected to the base and has a second free end. The first and second free ends are adapted to engage a wire received by the contact termination member. The first and second free ends are non-parallel. The first and second spring arms engage the inserted wire to securely retain the wire within the contact termination member.

18 Claims, 6 Drawing Sheets

CONTACT TERMINATION MEMBER FOR AN ELECTRICAL RECEPTACLE

FIELD OF THE INVENTION

The present invention relates to a contact termination member for an electrical receptacle. More particularly, the present invention relates to a contact termination member having first and second spring arms adapted to retain an inserted wire. Still more particularly, the present invention relates to a single unitary contact-termination member having first and second spring arms disposed proximal an opening in the base of an electrical receptacle, and free ends of the first and second spring arms disposed substantially perpendicularly to one another to bias an inserted wire against the contact termination member.

BACKGROUND OF THE INVENTION

Electrical receptacles are typically installed in new commercial and residential construction projects in large quantities. Push-in wiring connections located on a rear surface of the electrical receptacle allow for quick and easy engagement of the wire with the electrical receptacle without having to use the tedious binding head screw terminal connections. The bared end of a wire is simply inserted through the opening in the rear surface of the electrical receptacle until it is gripped by an internal contact member. Conventional electrical receptacles typically use a single spring arm to retain the inserted wire within the electrical receptacle.

Furthermore, electrical receptacles are designed to accommodate safe and convenient circuit installation by homeowners who are not electricians and have little experience and background in electrical matters. Therefore, push-in wiring terminals need to be easy to use, while providing a safe and secure electrical and mechanical connection between the inserted wire and the electrical receptacle.

Since push-in wiring connections do not grip the wire as securely as binding head screw terminal connections, the push-in wiring connection may be disturbed as the wired receptacle is mounted. Thus, a need exists for a contact termination member that securely retains an inserted wire within the electrical receptacle, while providing a quick and easy connection between the wire and electrical receptacle.

Another problem with push-in wiring connections is that the single spring arm is movable from outside the electrical receptacle to release an inserted wire. The spring arm may retain subsequently inserted wires less securely within the electrical receptacle after being deformed to release a previously inserted wire, thereby causing an unsafe electrical connection. This results in poor or failed electrical connections, which may cause a fire due to the poor connection. Thus, a need exists for a contact termination member that is not deformable from outside the electrical receptacle to release an inserted wire.

Conventional push-in wiring electrical receptacles are disclosed in U.S. Pat. No. 2,705,785 to Benander; U.S. Pat. No. 3,325,768 to Munroe; U.S. Pat. No. 3,489,985 to Martin; and U.S. Pat. No. 3,967,873 to Schumacher, the subject matters of which are hereby incorporated by reference in their entirety.

Thus, there is a continuing need to provide improved contact termination members for push-in wiring connections of electrical receptacles.

SUMMARY OF THE INVENTION

Accordingly, it is a primary objective of the present invention to provide an improved contact termination member for an electrical receptacle.

A further objective of the present invention is to provide an improved contact termination member having first and second spring arms adapted to securely retain an inserted wire.

A still further objective of the present invention is to provide a contact termination member in which the first and second spring arms have free ends disposed substantially perpendicularly to one another.

Still another objective of the present invention is to provide a contact termination member having a tab disposed on a wall thereof to provide a third point of contact for an inserted wire after the first and second spring arms.

The foregoing objectives are basically attained by a contact termination member for an electrical receptacle. A first spring arm is connected to a base of the electrical receptacle, and has a first free end. A second spring arm is connected to the base and has a second free end. The first and second free ends are adapted to engage a wire received by the contact termination member. The first and second free ends are non-parallel.

The foregoing objectives may also be attained by a contact termination member for an electrical receptacle. A first spring arm is connected to a base of the contact termination member and has a first free end. A second spring arm is connected to the base and has a second free end. The first and second free ends are adapted to engage a first wire received by the contact termination member. A third spring arm is connected to the base and has a third free end. The third spring arm is substantially colinear with the first spring arm. A fourth spring arm is connected to the base and has a fourth free end. The fourth free end is substantially parallel to the second free end. The third and fourth free ends are adapted to engage a second wire received by the contact termination member.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

Throughout the drawings, like reference numerals will be understood to refer to like parts, components and structures.

DETAILED DESCRIPTION OF THE INVENTION

Figure 1:
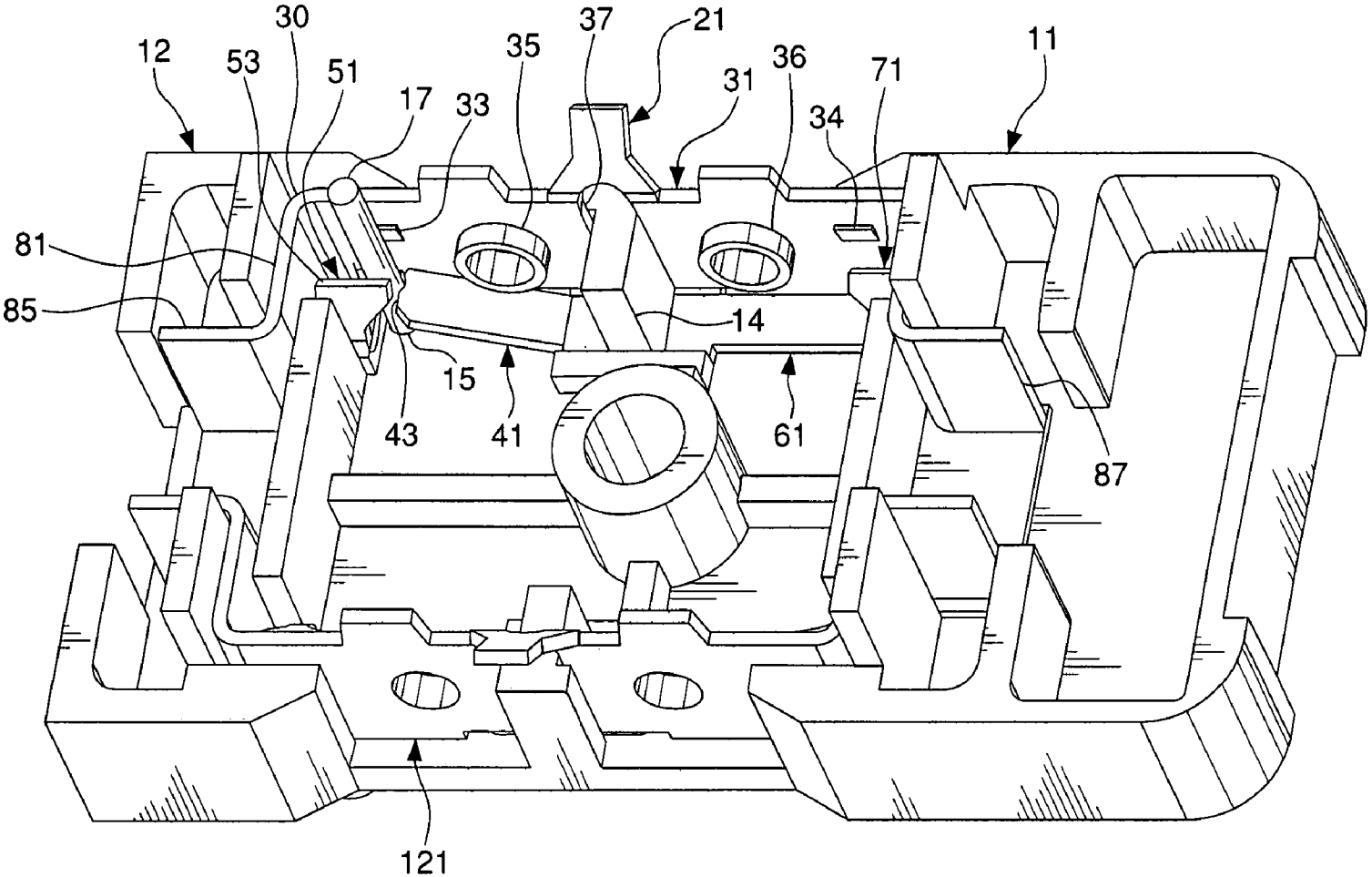
FIG. 1 is a perspective view of a contact termination member disposed in a base of an electrical receptacle and receiving a wire.

As shown in FIGS. 1-7, the present invention relates to a contact termination member 21 for an electrical receptacle 11. A first spring arm 41 is connected to a base 31 of the contact termination member 21 and has a first free end 43. A second spring arm 51 is connected to the base 31 and has a second free end 53. The first and second free ends 43 and 53 are adapted to engage a wire 17 received by the contact termination member 21. The first and second free ends 43 and 53 are non-parallel. The contact termination member 21 provides push-in wire termination for an electrical receptacle 11. Preferably, push-in wire termination is an alternative termination in addition to screw connection termination for electrically connecting a wire to the electrical receptacle.

The contact termination member 21 has a base 31 to which first and second spring arms 41 and 51 are connected. The base 31 has a first fastener hole 35 and a second fastener hole 36, which are preferably threaded and adapted to receive fasteners, such as screws (not shown), to electrically and mechanically secure a wire to the electrical receptacle 11 when the wire is not push-in terminated. A slot 37 extends inwardly from an edge 38 of the base 31 and is adapted to receive a mounting post 14 of the electrical receptacle 11 to facilitate disposing the contact termination member 21 in the electrical receptacle.

Figure 2:
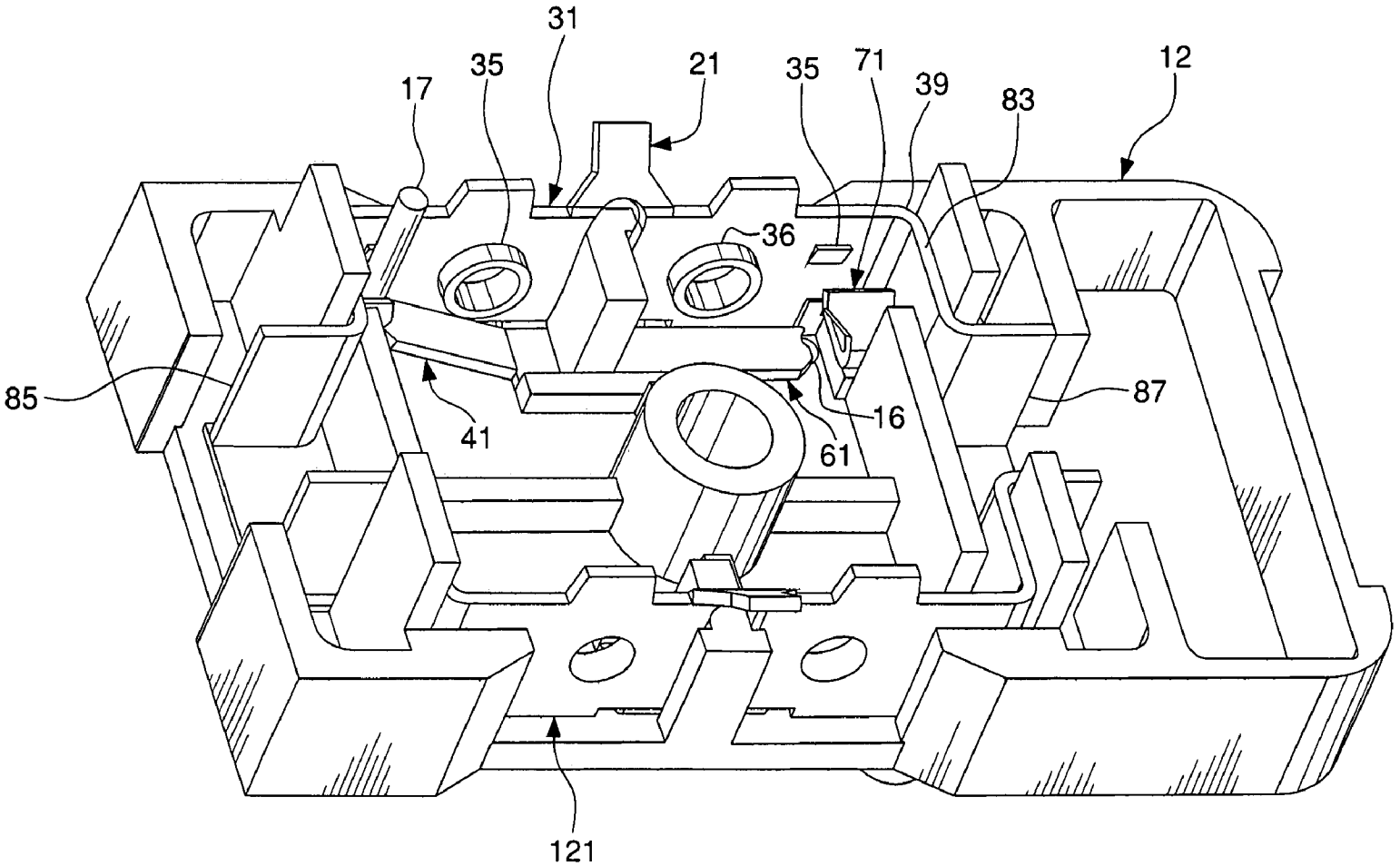
FIG. 2 is another perspective view of the contact of FIG. 1 showing the contact having a second pair of retention arms proximal a second opening in the electrical receptacle base.
Figure 3:
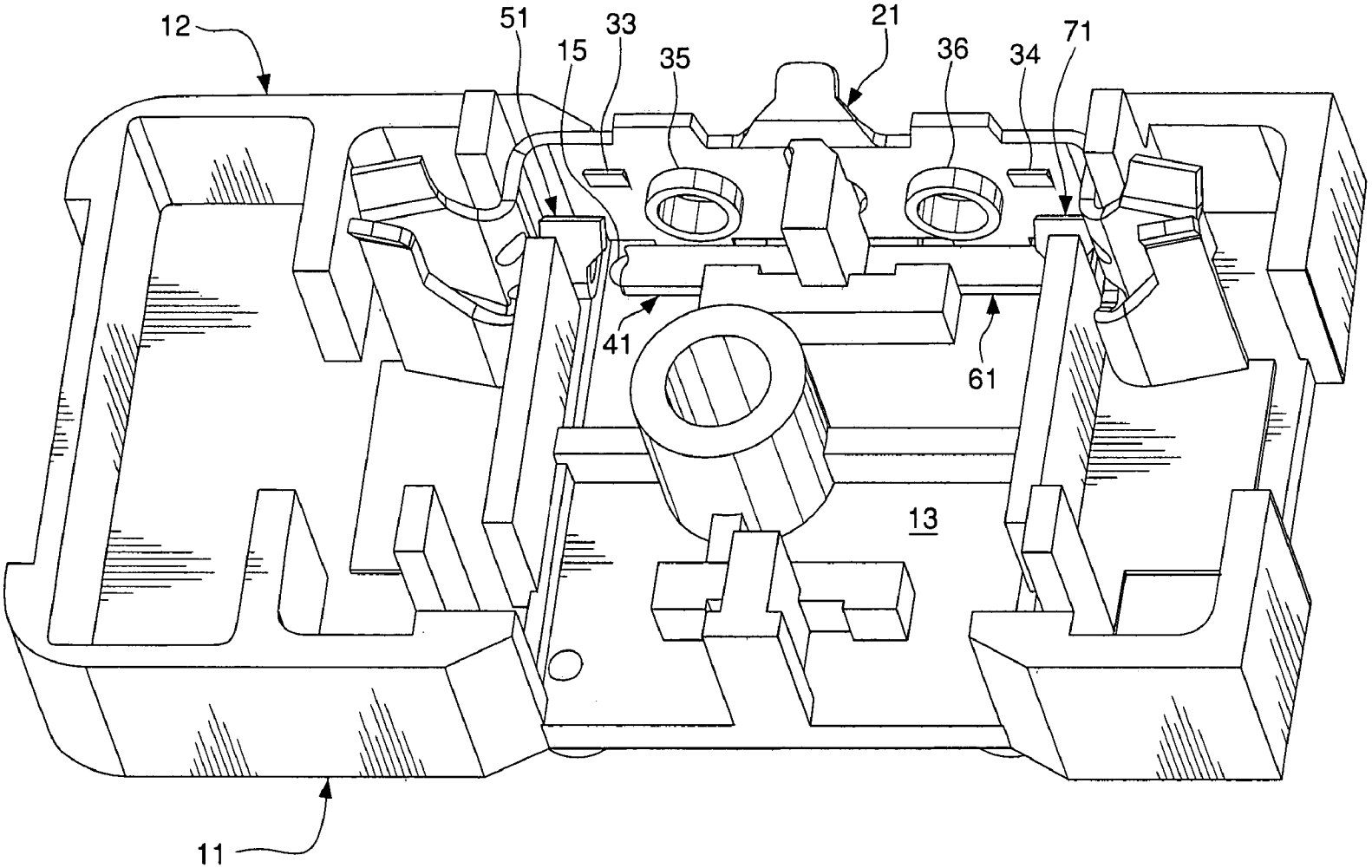
FIG. 3 is a perspective view of a contact termination member disposed in a base of an electrical receptacle and showing the female contact ends of the contact termination member.

The base 31 has a first end 30 and a second end 39, as shown in FIGS. 1-3. A first leg 81 extends substantially perpendicularly from the first end 30 of the base 31. A second leg 83 extends substantially perpendicularly from the second end 39 of the base 31. In an exemplary embodiment shown in FIGS. 1-2, a third leg 85 extends substantially perpendicularly from the first leg 81 and a fourth leg 87 extends substantially perpendicularly from the second leg 83, as shown in FIGS. 1 and 2. Alternatively, as shown in FIGS. 3-6, another exemplary embodiment has female contact ends 185 and 187 extending from the first and second legs 81 and 83, respectively. The female contact ends 185 and 187 are adapted to receive the male prongs of a plug (not shown) inserted into the electrical receptacle 11.

Figure 4:
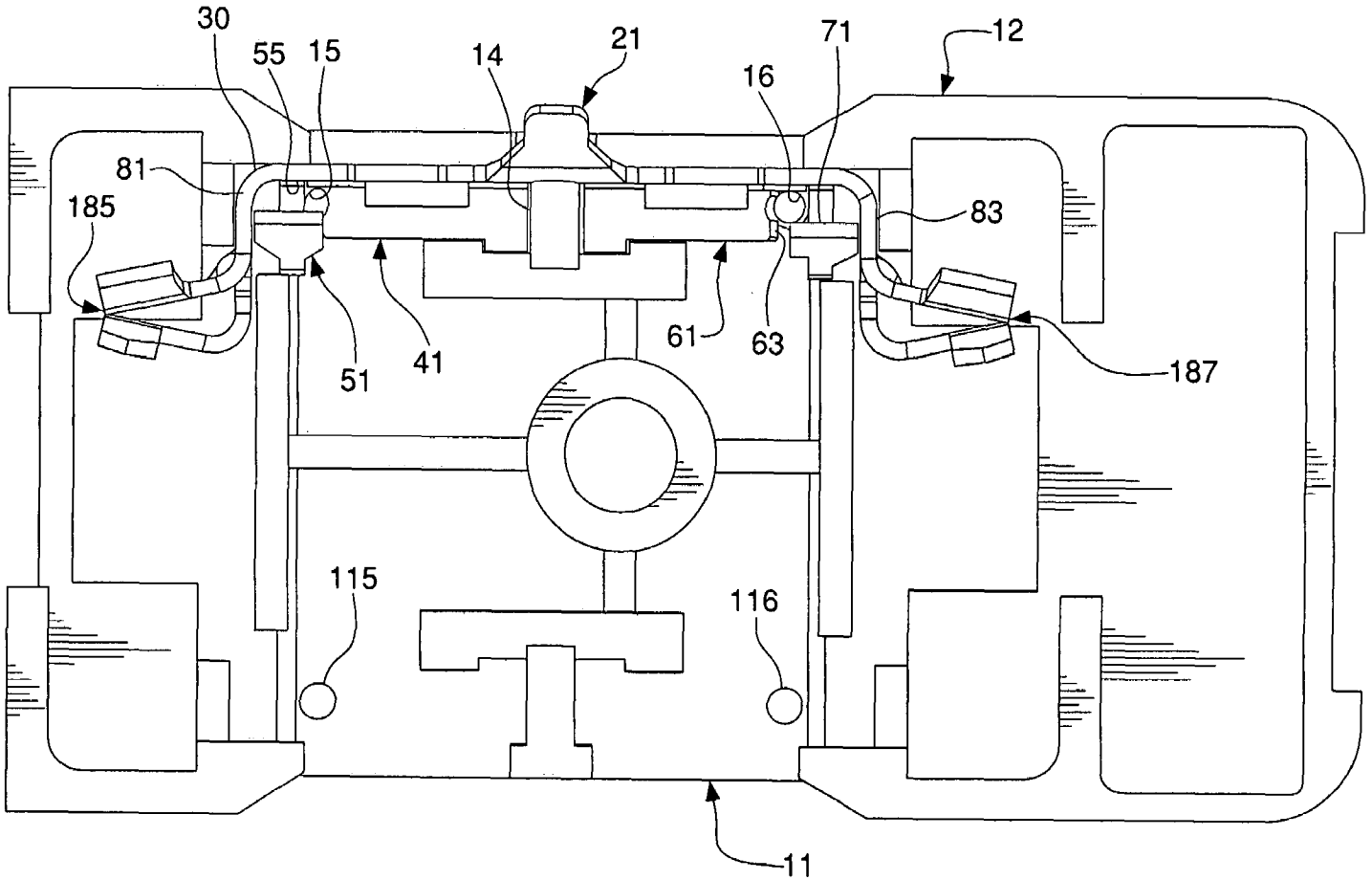
FIG. 4 is a top plan view of the contact termination member of FIG. 3 disposed in the base of an electrical receptacle.
Figure 5:
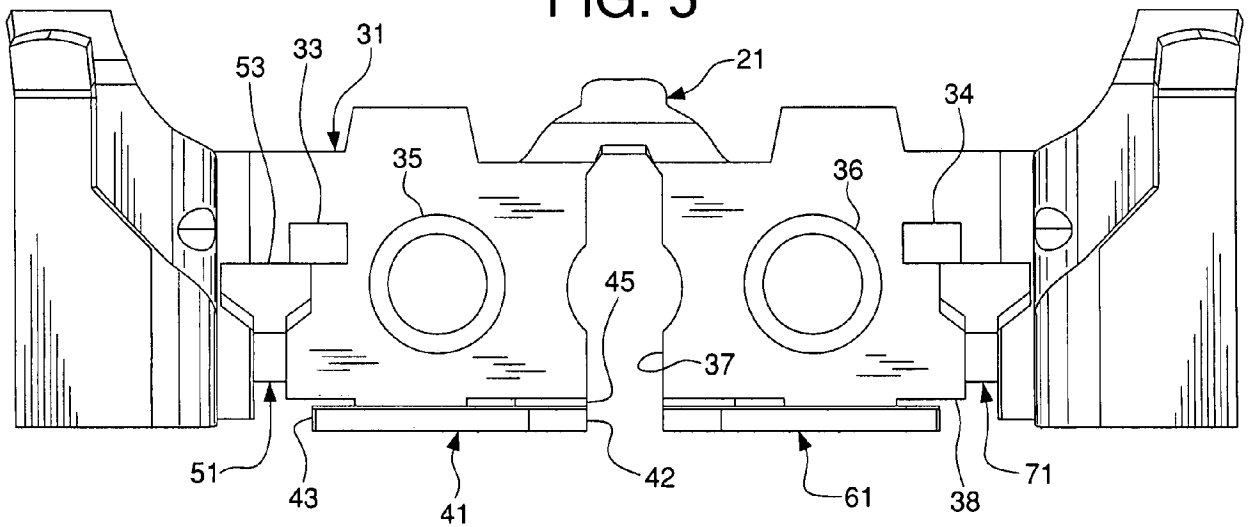
FIG. 5 is a front elevational view of the contact termination member of FIG. 3 removed from the electrical receptacle base.
Figure 6:
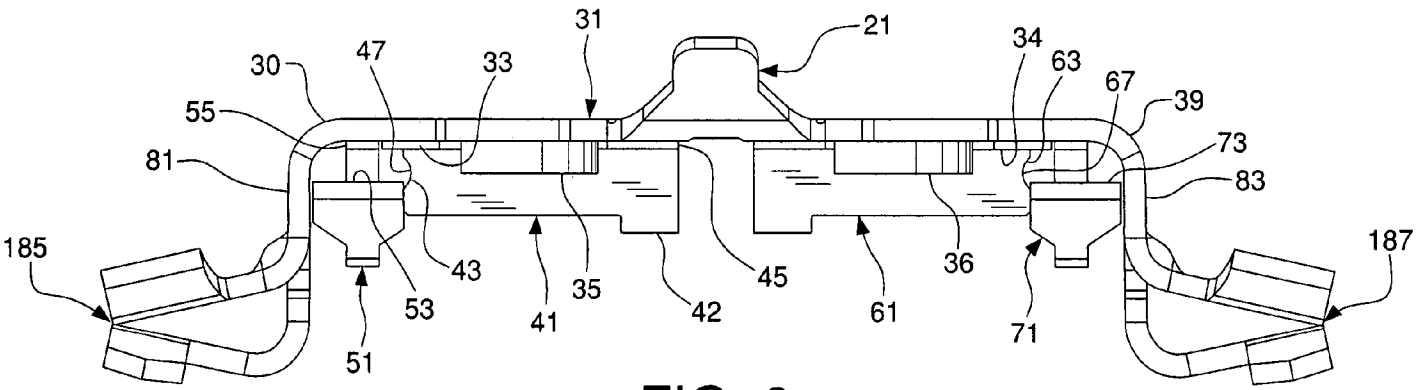
FIG. 6 is a top plan view of the contact termination member of FIG. 4.

A first spring arm 41 is connected to the base 31, as shown in FIGS. 1-2. Preferably, the first spring arm 41 is connected to the base 31 proximal the slot 37. As shown in FIG. 6, a connecting arm 42 connects the first spring arm 41 to the base 31. Preferably, the first spring arm 41 is substantially parallel to the base 31, as shown in FIGS. 4 and 6. When not engaging a wire 17, the first spring arm is in a first position that is preferably substantially parallel to the lower surface 13 of the receptacle 11, as shown in FIGS. 3 and 5. When a wire 17 is inserted in the first opening 15, the first spring arm 41 is adapted to move to a second position, as shown in FIGS. 1 and 2, which is not substantially parallel to the lower surface 13 of the electrical receptacle 11.

The first spring arm 41 has a free end 43 adapted to engage an inserted wire 17, as shown in FIG. 1. Preferably, the first free end 43 has a recess 47 to facilitate receiving a stripped portion of the wire 17. The first free end 43 is preferably substantially perpendicular to the base 31, as shown in FIGS. 4 and 6.

A second spring arm 51 is connected to the base 31, as shown in FIGS. 1-2. Preferably, the second spring arm 51 is connected to the base 31 proximal the first end 30, as shown in FIGS. 4 and 6. The second spring arm 51 has a fixed end 55 connected to the base 31. The second spring arm 51 extends outwardly substantially perpendicularly to the base 31 of the contact termination member 21 from the fixed end 55. The second spring arm 51 then bends inwardly toward the base 31 and ends at a free end 53, as shown in FIGS. 2 and 3, thereby forming a curled spring arm. The free end 53 of the second spring arm 51 is adapted to engage the wire 17 inserted in the first opening 15, as shown in FIGS. 1 and 2. The first and second free ends 43 and 53 are non-parallel, as shown in FIGS. 1-6. Preferably, the free end 53 of the second spring arm 51 is substantially perpendicular to the free end 43 of the first spring arm 41, as shown in FIG. 6.

The contact termination member 21 preferably has a third spring arm 61 connected to the base 31 proximal the slot 37 that is substantially identical to the first spring arm 41 but oriented in mirror image thereto, as shown in FIGS. 1-6. Preferably, the third spring arm 61 extends in a direction opposite to that of and colinear with the first spring arm 41, such that the free end 63 of the third spring arm 61 faces in a direction substantially opposite to the free end 43 of the first spring arm 41. A third free end 63 of the third spring arm 61 is adapted to engage a wire inserted in the second opening 16 in the base 31.

The contact termination member 21 preferably has a fourth spring arm 71 connected to the base 31 proximal the second end 39 of the base that is substantially identical to the second spring arm 51, as shown in FIGS. 1-6. Preferably, the fourth spring arm 71 substantially parallels the second spring arm 51. A fourth free end 73 of the fourth spring arm 71 is adapted to engage a wire inserted in the second opening 16 in the base 31. The fourth free end 73 is preferably substantially parallel to the second free end 53 and substantially perpendicular to the third free end 63, as shown in FIG. 6.

A first tab 33 extends outwardly from the base 31, as shown in FIGS. 5 and 6. The first tab 33 is adapted to contact the wire 17 engaged by the first and second free ends 43 and 53 of the first and second spring arms 41 and 51, respectfully, to further facilitate retaining the wire 17 in the electrical receptacle 11, as shown in FIGS. 1 and 2. The first tab 33 is a third point of contact, in addition to the first and second spring arms 41 and 51, for engaging an inserted wire 17.

The contact termination member 21 preferably has a second tab 34 extending outwardly from the base 31, as shown in FIGS. 5 and 6. The second tab 34 is adapted to contact a wire engaged by the third and fourth free ends of the third and fourth spring arms 61 and 71, respectfully, to further facilitate retaining the wire in the electrical receptacle 11. The second tab 34 is a third point of contact, in addition to the third and fourth spring arms 61 and 71, for engaging an inserted wire.

First and second fastener holes 35 and 36 in the base 31 are adapted to receive fasteners (not shown). These fasteners provide an alternative means to electrically and mechanically secure wires to the electrical receptacle 11. A stripped end of a wire is wrapped around the fastener, which is then threaded into the respective fastener hole such that the wire is secured between the fastener and the base 31 of the contact termination member 21, thereby electrically and mechanically terminating the wire.

A second contact termination member 121, as shown in FIGS. 1 and 2, may be disposed in the lower portion 12 of the electrical receptacle 11. The second contact termination member is substantially identical in structure and operation to the first contact termination member 21.

Figure 7:
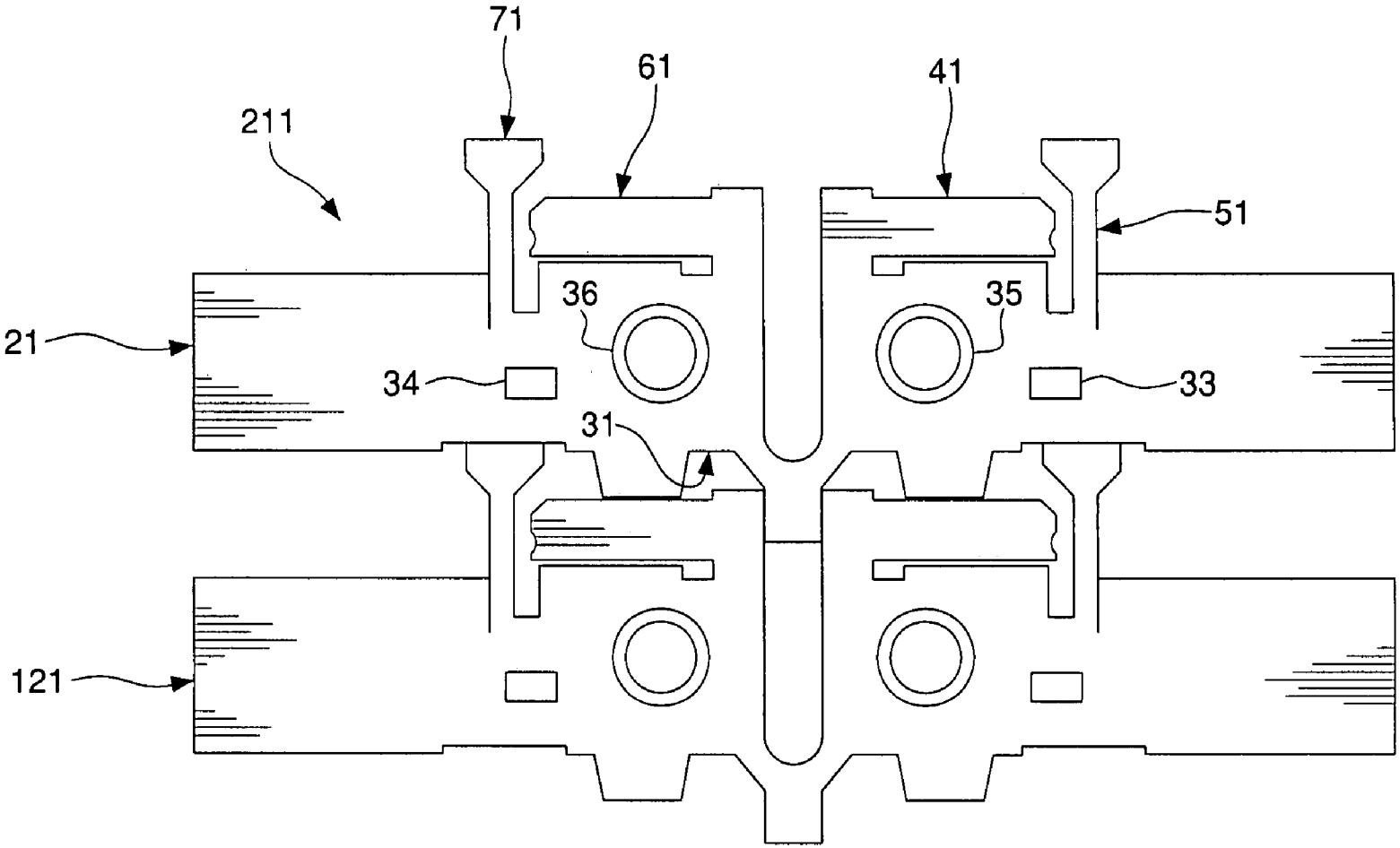
FIG. 7 is a pattern blank for manufacturing two contact termination members as shown in FIG. 1.

Preferably, the contact termination member is unitarily formed as a single piece and made of a metal, such as brass. FIG. 7 shows a pattern blank 211 for manufacturing the first and second contact termination members 21 and 121 as a single piece. Although the pattern blank shown in FIG. 7 is used to manufacture two contact termination members, the pattern blank may be formed to manufacture one or more than two contact termination members.

Assembly and Disassembly

The contact termination member 21 according to exemplary embodiments of the present invention is shown disposed in a lower portion 12 of an electrical receptacle 11 in FIGS. 1-4 and removed from the electrical receptacle in FIGS. 5 and 6.

A slot 37 extends inwardly from an edge 38 of the base 31 and is adapted to receive a mounting post 14 of the electrical receptacle 11 to facilitate securing the contact termination member 21 in the electrical receptacle. An upper portion (not shown) of the electrical receptacle is secured to a lower portion 12 of the electrical receptacle 11 in any suitable manner, thereby securing the contact termination member within the electrical receptacle.

To mechanically and electrically terminate a wire, the wire 17 is inserted in the first opening 15 in the lower surface 13 of the electrical receptacle 11. The wire 17 passes through the first opening 15, which is proximal the free end 43 of the first spring arm 41 and the fixed end 55 of the second spring arm 51. The wire 17 engages the free end 43 of the first spring arm 41, which is initially substantially parallel to the lower surface 13 of the lower portion 12 of the electrical receptacle 11. As the wire 17 is further inserted through the first opening 15, the wire moves the first spring arm 41 to a second position, as shown in FIG. 1. Preferably, the free end 43 of the first spring arm 41 has a recess 47 that engages the inserted wire, thereby increasing the contact area between the wire and first spring arm to more securely retain the wire within the electrical receptacle 11.

As the wire moves the first spring arm 41 from the first position (FIG. 5) to the second position (FIG. 1), the wire engages the free end 53 of the second spring arm 51. The wire 17 is held against the base 31 of the contact termination member 21 by the free ends of both the first and second spring arms 41 and 51, respectively. As shown in FIG. 1, a first tab 33 may be disposed on the base 31 of the contact termination member 21 to add a third point of contact with the inserted wire 17 to further facilitate retention of the wire. Preferably, there is no opening in the electrical receptacle 11 for insertion of a tool to release the inserted wire 17 from engagement with the free ends of the first and second spring arms 41 and 51.

A second wire inserted in the second opening 16 is mechanically and electrically secured within the electrical receptacle 11 by the third and fourth spring arms 61 and 71 in a substantially similar manner. Wires inserted in third and fourth openings 115 and 116 (FIG. 4) are mechanically and electrically secured within the electrical receptacle 11 by a second contact termination member 121 (FIGS. 1 and 3) in a manner substantially similar to that of the first contact termination member 21.

While advantageous embodiments have been chosen to illustrate the invention, it will be understood by those skilled in the art that various changes and modifications may be made therein without departing from the scope of the invention as defined in the appended claims.

What is claimed is:

1. A contact termination member for an electrical receptacle, comprising:

a base;

a first spring arm connected to said base and having a first free end, said first spring arm extending substantially parallel to said base when said contact termination member is disposed in the electrical receptacle; and a second spring arm connected to said base and having a second free end, said first and second free ends grip and engage a wire received by the contact termination member, said first and second free ends being adjacent and non-parallel.

2. A contact termination member for an electrical receptacle according to claim 1, wherein said second spring arm extends substantially perpendicularly to said base of said contact termination member.

3. A contact termination member for an electrical receptacle according to claim 1, wherein said first free end is substantially perpendicular to said second free end.

4. A contact termination member for an electrical receptacle according to claim 1, wherein said first free end has a recess adapted to receive the wire.

5. A contact termination member for an electrical receptacle according to claim 1, wherein said contact termination member is unitarily formed as a single piece.

6. A contact termination member for an electrical receptacle according to claim 1, wherein said base has a fastener hole adapted to receive a fastener to secure the wire when the wire is not retained by said first and second spring arms.

7. A contact termination member for an electrical receptacle according to claim 1, wherein a tab extends outwardly from said base and is adapted to contact the wire engaged by said first and second free ends to further facilitate retaining the wire in said contact termination member.

8. A contact termination member for an electrical receptacle, comprising:

a base;

a first spring arm connected to said base and having a first free end;

a second spring arm connected to said base and having a second free end, said first and second free ends grip and engage a first wire received by said contact termination member;

a third spring arm connected to said base and having a third free end, said third spring arm being substantially colinear with said first spring arm such that a longitudinal axis through said first and third spring arms is substantially equidistant along its length from said base;

a fourth spring arm connected to said base and having a fourth free end, said fourth free end being substantially parallel to said second free end, said third and fourth free ends grip and engage a second wire received by said contact termination member; and each of said first and third free ends having a recess which respectively receive the first and second wires.

9. A contact termination member for an electrical receptacle according to claim 8, wherein said contact termination member is unitarily formed as a single piece.

10. A contact termination member for an electrical receptacle according to claim 8, wherein said first free end is substantially perpendicular to said second free end, and said third free end is substantially perpendicular to said fourth free end.

11. A contact termination member for an electrical receptacle according to claim 8, wherein said base has first and second fastener holes adapted to receive first and second fasteners to secure the first and second wires when the first and second wires are not retained by said first and second spring arms and said third and fourth spring arms, respectively.

12. A contact termination member for an electrical receptacle according to claim 8, wherein first and second tabs extend outwardly from said base and are adapted to contact the first and second wires engaged by said first and second free ends and by said third and fourth free ends, respectively, to further facilitate retaining the first and second wires in said contact termination member.

13. A contact termination member for an electrical receptacle according to claim 8, wherein a female contact end extends outwardly from each of opposite ends of said base and are adapted to receive prongs of a plug inserted into said electrical receptacle.

14. A contact termination member for an electrical receptacle, comprising:

a base having a first end and a second end, a first female contact end extending from said first end and a second female contact end extending from said second end;

a first spring arm connected to said base and having a first free end, said first spring arm extending toward said first female contact end; and a second spring arm connected to said base and having a second free end, said second free end of second spring arm extending toward said base, said first and second free ends grip and engage a wire received by said contact termination member.

15. A contact termination member for an electrical receptacle according to claim 14, wherein said first spring arm moves the inserted first wire toward said first female contact end and said second spring arm moves the inserted wire toward said base.

16. A contact termination member for an electrical receptacle according to claim 15, wherein a tab extends outwardly from said base and is adapted to contact the first wire engaged by said first and second free ends to further facilitate retaining the first wire in said contact termination member.

17. A contact termination member for an electrical receptacle according to claim 14, wherein a third spring arm is connected to said base and has a third free end, said third spring arm being substantially colinear with said first spring arm; and a fourth spring arm is connected to said base and has a fourth free end, said fourth free end being substantially parallel to said second free end, said third and fourth free ends being adapted to engage a second wire received by the contact termination member.

18. A contact termination member for an electrical receptacle according to claim 17, wherein said first free end is substantially perpendicular to said second free end, and said third free end is substantially perpendicular to said fourth free end.

* * * * *